United States Patent [19]

Kurrasch

[11] Patent Number: 4,515,087

[45] Date of Patent: May 7, 1985

[54] HEIGHT ADJUSTABLE TABLE

[75] Inventor: Andrew J. Kurrasch, Saugatuck, Mich.

[73] Assignee: Herman Miller, Inc., Zeeland, Mich.

[21] Appl. No.: 467,245

[22] Filed: Feb. 17, 1983

[51] Int. Cl.[3] ..... A47B 9/00

[52] U.S. Cl. ..... 108/147; 108/144

[58] Field of Search ..... 108/147, 146, 145, 144; 74/89.15, 105

[56] References Cited

U.S. PATENT DOCUMENTS

| | | | |
|---|---|---|---|
| 132,285 | 10/1872 | Hiestand | 108/147 X |
| 1,527,895 | 2/1925 | Mazoch | 108/147 |
| 1,691,634 | 11/1928 | Bienvenu | 108/147 |
| 1,692,541 | 11/1928 | Bliss et al. | 74/89.15 |

FOREIGN PATENT DOCUMENTS

| | | | |
|---|---|---|---|
| 540605 | 5/1957 | Canada | 108/147 |

*Primary Examiner*—James T. McCall

*Attorney, Agent, or Firm*—Varnum, Riddering, Schmidt & Howlett

[57] ABSTRACT

A table (10) includes telescoping legs (14, 16), each of which has a stationary member (18, 114) and a sliding member (102) which are adapted for vertical travel relative to each other. A work surface (20) is mounted for vertical travel with the sliding members (102). The table (10) includes a height adjustment means including a drive mechanism (70) which causes the sliding leg member (102) to move vertically relative to the stationary leg member (18, 114). Supported on the frame and operatively connected between the drive mechanism (70) and sliding leg member (102) are levers (82). The levers (82) are pivotably mounted to a skirt (26) for rotation about the center portions thereof and rotate through a selected arc when the drive mechanism (70) is actuated. Rotation of the levers (82) by the drive mechanism (70) causes the sliding members (102) of the legs (14, 16) to be displaced vertically and carry with it the work surface (20).

14 Claims, 4 Drawing Figures

HEIGHT ADJUSTABLE TABLE

DESCRIPTION

1. Technical Field

The invention relates to a table including a mechanism for adjusting the height of the tabletop.

2. Background Art

In the office environment it is common to support office machines such as typewriters and now video display terminals of word processors and the like on tables. In the past, these tables had been of a fixed height or at most included leveling pads which allowed for very limited adjustment of the table height. The leveling pads or other types of adjustment mechanism mounted at the base of the table did not provide much flexibility in changing the table height to accommodate the user of the table.

It is becoming more important to have height adjustment capability in work surfaces. Work tables may be used by different people at different shifts in each 24-hour period. Due to different height and comfort positions of different people, it is desirable to change the height of work surfaces during each 24 hour period.

There have been tables and other types of support mechanisms which in the past allowed for adjustment of the tabletop. These height adjustment mechanisms often took the form of scissored arms which were mounted to the supports for the tabletop and which were rotated through an angle in order to effect an adjustment of the tabletop height. Other types of adjustment mechanisms included belt and pulley drives wherein the table legs would mount a rod and nut arrangement driven by a pulley or like type of drive. In these types of tables, a crank mechanism drives belts which are connected to the threaded rods so that rotation of the rods changes the tabletop height.

An example of a table which included a mechanism for adjusting the height of tabletop is shown in the Bienvenu U.S. Pat. No. 1,691,634, issued Nov. 13, 1928. The Bienvenu patent discloses a work stand including a tabletop secured to a vertical support which moves vertically relative to a stationary frame. An adjustment mechanism comprising two arms pivoted at their central portions and connected between the fixed frame and the moving frame. A screw mechanism fixed between the ends of the two arms is used to adjust the table height.

The Timroth U.S. Pat. No. 399,220, issued Mar. 5, 1889, disclosed a very simple form of an adjustment mechanism wherein scissored arms pivoted at their center portions are mounted between a tabletop and a stationary support. An adjustment screw drives one of the arms while the other of the arms is fixed between the tabletop and a frame. The table height is adjusted by turning a threaded rod which in turn drives the adjustment nut horizontally so as to cause a change in the angular relationship between the arms.

The St. John U.S. Pat. No. 3,253,284, issued May 31, 1966, discloses an adjustment mechanism of the type described above wherein the frame includes vertical members which receive threaded shafts fixed to the underside of the horizontal surface. The shafts carry nuts about which are reeved chains for a chain-and-sprocket drive. The nuts are fixed relative to the threaded shafts which travel vertically in the vertical members of the frame. The nuts are rotated by a common drive crank. It can be seen that a plurality of threaded-rod drive mechanisms are used to change the height of the horizontal surface.

The Jay U.S. Pat. No. 3,385,238, issued May 18, 1968, discloses another form of an adjustable height table wherein two ball-screw drives are disposed in the vertical frame members, which ball-screw drives are simultaneously driven by a chain-and-sprocket mechanism. Each of the legs of the table shown in the Jay patent is driven by a separate nut-and-screw drive mechanism.

While the above-described tables include means for adjusting the height of the tabletop, the use of a dual-drive mechanism such as shown in the Jay patent or a separate screw-and-nut mechanism such shown in the St. John patent could lead to misalignment of the table height if the separate drive mechanisms were to become misaligned. Further, the duplication of relatively expensive drive mechanisms adds significant cost to the table. A scissors-type mechanism such as shown in the Timroth and Bienvenu patents also would not be feasible for use in a table which was to be used in an office environment as the scissors mechanism could interfere with the operator space or the cables used in word processing systems.

SUMMARY OF THE INVENTION

According to the invention, a table is provided with a vertically movable top surface. The table has a work surface and at least two legs, each of which has a stationary member and a movable member adapted to move vertically with respect to each other. Means secure the work surface to the legs movable members. An adjustment means is provided for moving the vertical members with respect to the stationary members, the adjustment means comprising at least two levers each of which is pivotably mounted to one of the stationary and movable members of the legs, and a drive means mounted to the one of the stationary and movable members to drive pivotable movement of the levers. One end of the levers has a leg engagement means to engage the other of the movable and stationary members of the legs and the other end of the levers has a means for engaging the drive means. Thus, vertical movement of the other end of the levers causes a corresponding and opposite movement of the one end of the levers to vertically adjust the position of the legs movable members with respect to the legs stationary members.

Preferably, the drive means includes a driven shaft, means for rotating the driven shaft and a nut mounted for travel along the driven shaft. The nut is operatively connected to the levers through the drive means engagement means. The shaft is conveniently driven through a drive shaft and belt for transmitting rotation from the drive shaft to the driven shaft. Pulleys are provided on the drive shaft and the driven shaft and a pulley belt is reaved about the pulleys. A hand crank is provided for rotating the drive shaft to thereby conveniently raise and lower the work surface.

In accordance with one embodiment of the invention, the levers are mounted to a frame which in turn is mounted to the tabletop and to the legs movable members. The drive shaft is likewise mounted to the frame so that it moves with the tabletop. Thus, the lever ends distal from the drive engagement means engages the stationary members of the legs.

The invention further contemplates a guide means including a cylindrical guide member for guiding the movement of the movable leg members with respect to the stationary leg members. Preferably, the cylindrical guide member is mounted to the movable guide member and slidably mounts elongated tubes which form a portion of the stationary members of the legs.

The connections between the levers and the nut and the levers and the legs form sockets so as to permit a hinge-like action between the levers and the nut on one hand and the levers and the legs on the other hand.

The invention provides a simple, convenient mechanism for raising and lowering a table top. The single drive shaft, multiple levers and sliding leg portions provide a low cost, effective mechanism, thereby avoiding dual or multiple drive threaded rods and minimizing mechanism useage of space beneath the table top.

BRIEF DESCRIPTION OF THE DRAWINGS

The invention will now be described with reference to the accompanying drawings wherein like members bear like reference numerals and wherein.

BEST MODE FOR CARRYING OUT THE INVENTION

Figure 1:
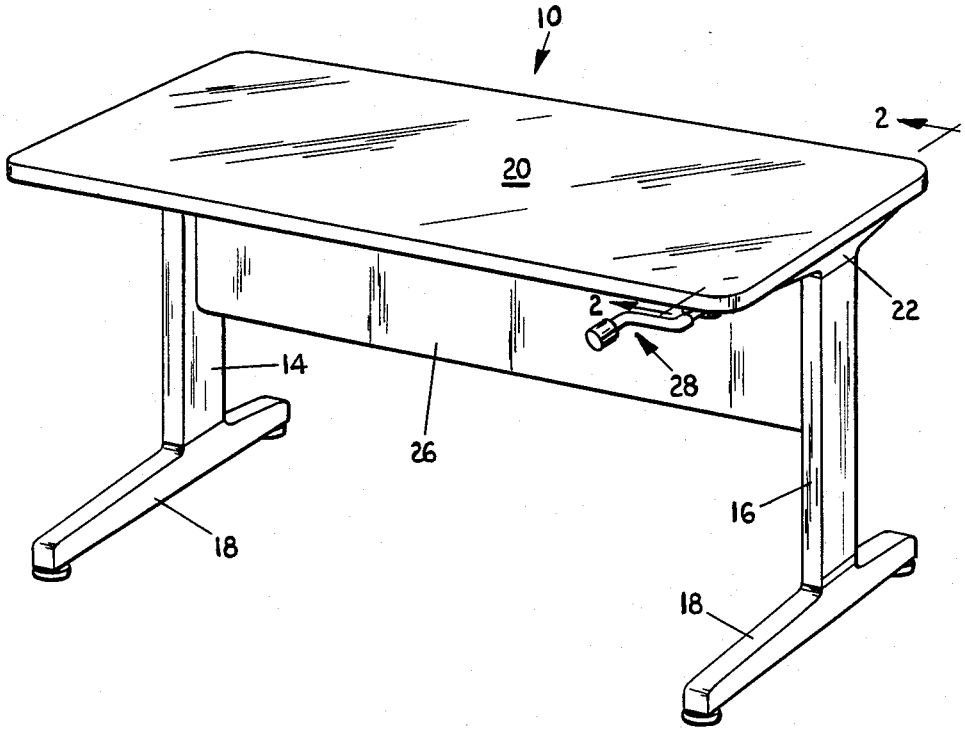
FIG. 1 is a perspective view of an adjustable height table in accordance with the invention.

Referring to the drawings and particularly to FIG. 1, there is shown a table 10 having legs 14 and 16, each of which is supported on a base 18. A tabletop 20 is secured to the legs 14 and 16 through brackets 22 and 24. A skirt 26 is secured beneath the tabletop and between the table legs 14 and 16. A crank mechanism 28 is mounted at one side of the tabletop for adjusting the height of the tabletop in accordance with the needs of the user of the table. Feet 19 are provided on the bottom of the bases 18 in convetional fashion.

Figure 2:
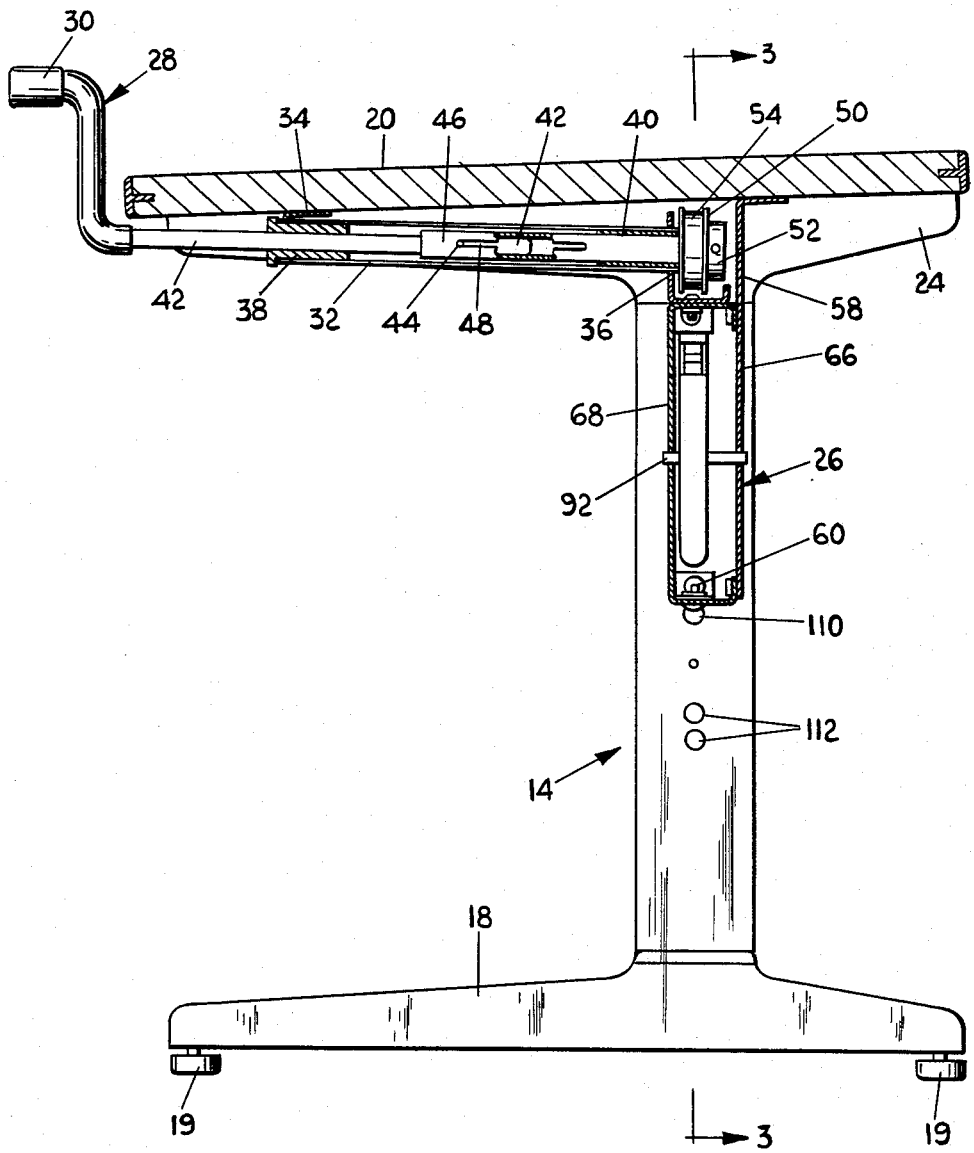
FIG. 2 is a cross-sectional view of the table of FIG. 1 taken along lines 2—2 thereof.

Referring now to FIG. 2 in particular, the crank mechanism 28 has a rotatable handle 30 and is supported for rotation beneath the tabletop in a mounting comprising a mounting tube 32 which is secured to the tabletop through a bracket 34 and is secured to the skirt 26 through a bracket 36. Bushings 38 and 40 are provided at each end of the mounting tube 32. The crank mechanism 28 has an elongated stem 42 which is slidably mounted in a tube 46 having an elongated slot 48. A pin 44 in the stem 42 extends into the elongated slot 48 to prevent relative rotation between the stem 42 and the tube 46. A pulley 50 is mounted nonrotatably to the tube 46 through an end cap 52. A pulley belt 54 is reaved around the pulley 50.

Thus, the pulley belt 54 is driven by rotating the crank 28. The slidable connection between the stem 42 and the tube 46 premits the crank to be stored beneath the table and out of view when the crank is not in use.

Figure 3:
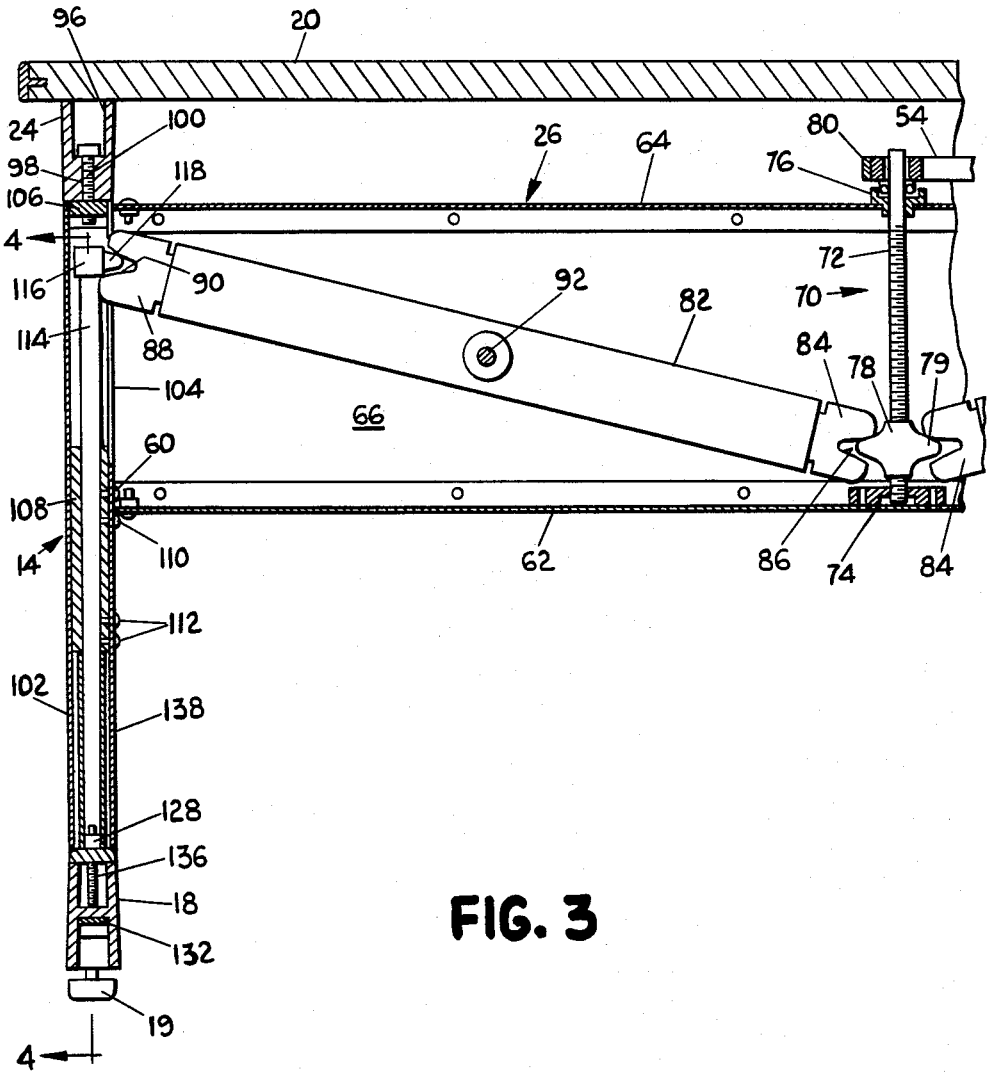
FIG. 3 is a cross-sectional view of the table of FIG. 1 taken along lines 3—3 of FIG. 2.

Referring now to FIGS. 2 and 3, the skirt comprises a bottom wall 62, a top wall 64, side wall 66 and side wall 68. As seen in FIG. 2, the walls of the skirt 26 form a vertically disposed elongated rectangle in cross-section. The skirt is mounted to each leg through a bolt 60 and is mounted to the tabletop 20 through a bracket 58.

A drive mechanism 70 is provided for raising and lowering the tabletop. The drive mechanism includes a threaded rod 72 which is journaled in a bearing 74 in the bottom wall 62 and bearing 76 in the top wall 64 of skirt 26. A nut 78 having a projecting nose 79 at each side is threaded onto the threaded rod 72. A pulley 80 is mounted nonrotatably to the threaded rod 72 and the pulley belt 54 is reaved around the pulley 80.

A lever 82 is pivotably mounted within the skirt 26 through a pivot pin 92. The lever 82 has a bifurcated nut engagement member 84 forming a slot or recess 86 on one end and a similar bifurcated engagement member 88 forming a slot or recess 90 at the other end. As illustrated in FIG. 3, the slot 86 of the engagement member 84 captures the projecting nose 79 of the nut 78. As the nut 78 is driven up and down along the threaded rod 72, the lever 82 will rotate about the pin 92.

The bracket 24 has a recess 96 in the upper portion thereof and a vertical bore 98 therein. A bolt 100 extends through the bore 98 and threadably engages tapped holes in a plate 106.

Each of the legs 14 and 16 is identical and accordingly only one such leg will be described. Each leg comprises a tubular housing 102 having a vertical slot or opening 104 in the upper portion thereof to allow for articulation of the engagement member 88 of lever 82. The plate 106 is securely mounted in the top of the tubular housing 102 so that the bracket 24 is securely mounted to the top of the tubular housing 102. The bracket 24 in turn is securely mounted to the tabletop 20 through screws (not shown) in a conventional manner. The tubular housing 102 extends down to the top of the base 18 when the drive mechanism is in the position illustrated in the drawings but the housing 102 is not connected to the base 18 in any way.

Figure 4:
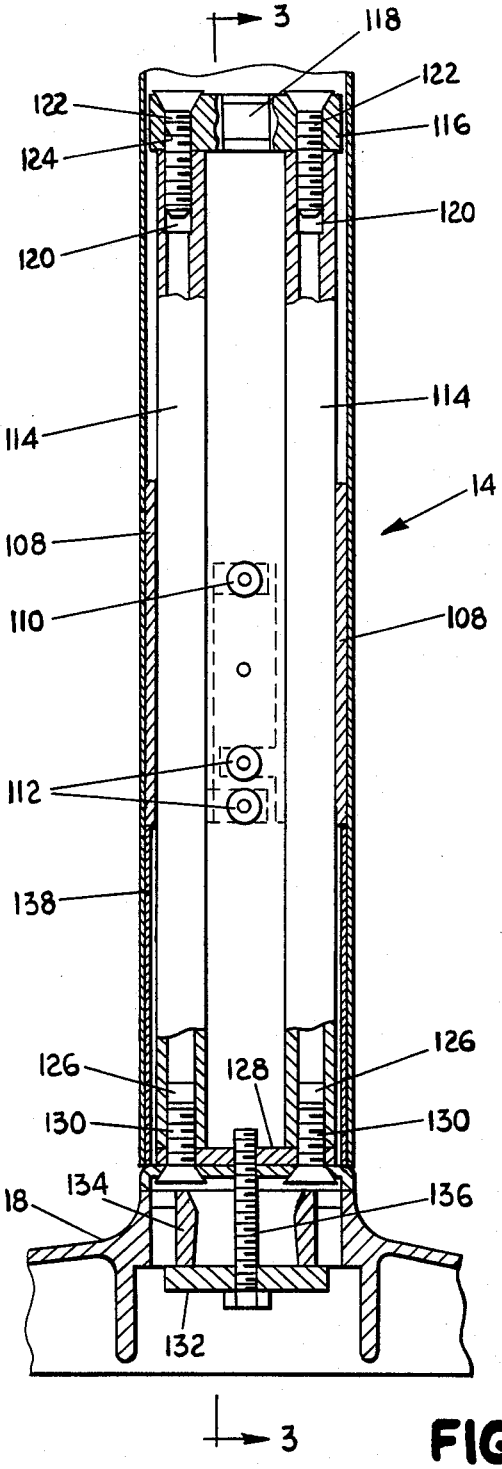
FIG. 4 is a partial sectional view of the table leg taken along lines 4—4 of FIG. 3.

A guide tube 108 is mounted within the tubular housing 102 and secured thereto through bolts 110 and 112. The guide tube 108 forms two vertical tubular cavities in which are slidably positioned two fixed tubes 114. Referring now to FIGS. 3 and 4, a stretcher bracket 116 having a projecting nose 118 is mounted to the top of the fixed tubes 114 through screws 122. To this end, the tubes 114 have tapped upper portions at 120 which threadably engage the screws 122. Holes 124 are provided in the stretcher bracket 116 through which the screws 122 extend.

A stretcher bracket 128 is also secured to the bottom of the tubes 114 at the base 18 through screws 130. To this end, the tubes 114 have tapped bottom portions 126 in which the screws 130 are threaded. Holes are provided through the stretcher bracket 128 for passage of the screws 130.

The stretcher bracket 128 in turn is mounted to the base 18 through a retainer plate 132 and a bolt 136. As seen in FIGS. 3 and 4, the interior of the base 18 is hollow and has ribs 134 against which the retainer plate 132 rests. The bolt 136 threadably engages a tapped hole in the top portion of the stretcher bracket 128. Thus, the tubes 114 are securely mounted to the base 18.

A shroud 138 which has an elongated, rectangular cross-section is mounted between the tubes 114 and the leg housing 102. The shroud 138 rests on the top portion of the base 18 and in the position of the drive mechanism illustrated in the drawing rests against the bolt 112.

In operation, as the crank handle 28 is rotated, pulley 50 rotates to drive belt 54 and thereby rotates pulley 80 and threaded rod 72. Rotation of the rod 72 in one direction will cause the nut 78 to travel upwardly along the rod 72, thereby rotating the lever 82 in a counterclockwise direction as illustrated in FIG. 3. As the lever 82 rotates, the engagement member 88 will bear against the nose 18 of the stretcher 116. Because the tubes 114 are fixed, the lever 18 will actually rotate about the nose 118. Because the lever 82 is secured to the shroud 26 through the pivot pin 92, the entire shroud, and therefore the top 20, will be raised as the nut 78 moves upwardly along the threaded rod 72. Raising of the tabletop 20 will cause the leg housing 102 to rise because the housing 102 is secured to the tabletop 20 and to the shroud 26. As the tubular housings 102 rise, the guide tube 108 will also rise and be guided in its movement along the fixed tubes 114. Further, during this action, the lower end of the tubular housings 102 will separate from the base 18. However, the gap between the base 18 and the housing 102 will be covered by the shroud 138 which will remain in resting position on the base 18.

The drive mechanism has been described with respect to a single lever 82 and one leg construction. As indicated above, the leg constructions are identical and identical levers 82 are provided between the nut 78 and each leg so that both legs are raised simultaneously.

The invention has been described with reference to a crank mechanism 28 on the right side of the desk. The invention, however, contemplates that the crank mechanism can be mounted on either side of the desk at the option of the user. The crank and mounting assembly can be positioned on either side of the desk without changing the operation or the structure of the drive mechanism. With this mechanism, there is no need of separate inventory of right- and left-hand oriented parts.

The use of this single common-drive mechanism for raising the telescoping leg members provides for a uniform change of height of the tabletop. This structure eliminates dual screw-drive mechanisms which are more difficult to raise and are more expensive to put into operation. Further, it eliminates any height inaccuracies between the two sides of the tabletop due to synchronization of two screw-drive mechanisms. The single-pulley drive mechanism is simple in operation and less expensive than a dual-belt drive mechanism which may be required to drive a dual screw-drive mechanism. Further, the dual lever mechanism occupies less space beneath the table than might be occupied by conventional sissors mechanisms.

The friction of the system is sufficient to maintain the tabletop in any adjusted position. Downward force on the tabletop is transmitted through the levers to the nut 78. The pitch of the threads in the threaded rod 72 and the threads in the nut 78 and the friction between these two elements are sufficient to maintain the nut 78 in its adjusted position on the threaded rod 72.

Whereas the invention has been described with respect to the drive means and the levers mounted to the tabletop and to the movable portions of the legs (tubular housing 102), it is within the scope of the invention to provide the drive mechanism and the levers on the stationary leg members (tubes 114) whereby the end of the levers distal from the nut-engaging ends thereof would engage the movable leg portions and thereby raise the table. Further, whereas the invention has been described with respect to a table having two legs, the table could have more than two legs and driven by two or more levers. At least two levers are believed necessary to raise the table but one lever for each leg can be provided in the event that there are more than two legs. Two levers could be used with multiple legs in the event that multiple legs are interconnected.

Reasonable variation and modification are possible within the scope of the foregoing disclosure and drawings without departing from the spirit of the invention which is defined by the appended claims.

The embodiments of the invention in which an exclusive property or privilege is claimed are defined as follows:

1. A table with a vertically movable top surface, said table comprising:

a work surface;

at least two legs, each of which has a stationary member and a movable member adapted to move vertically with respect to said stationary member;

means securing the work surface to said legs movable members;

at least two levers pivotably mounted to one of said stationary and movable members of said legs, each of said levers having at one end thereof a leg engagement means to engage the other of said movable and stationary members of one of said legs and having at the other end thereof drive engagement means;

a drive means mounted to the one of said stationary and movable members and adapted to vertically drive said drive engagement means on the other ends of said levers, said drive means including a driven shaft, means for rotating said driven shaft, and a nut mounted for travel along the driven shaft and engagable with said levers;

the improvement which comprises:

an enlarged diameter on said nut and said levers drive engagement means comprising recesses for receiving said enlarged diameter on said nut so as to operatively connect said nut to said levers, said enlarged diameter and recesses allowing for hinge-like movement of said levers relative to said nut during rotation of said lever;

whereby rotation of said drive shaft results in vertical movement of said nut and results in a corresponding vertical movement of said work surface with respect to said legs stationary members.

2. The table of claim 1 wherein said means for rotating said driven shaft includes a drive shaft and a belt means for transmitting rotation of said drive shaft to said driven shaft.

3. The table of claim 2 wherein each of said shafts mounts pulleys about which said belt means are reeved.

4. The table of claim 3 and further including a hand crank for rotating said drive shaft.

5. The table of claim 1 wherein said levers are mounted to said legs movable members and each of said stationary members includes a lever-engagement means which forms a socket with said leg-engagement means for hinge-like movement of said levers relative to said engagement means during rotation of said lever.

6. The table of claim 1 and further comprising a frame extending between said legs and wherein said driven shaft is supported at a central portion of said frame.

7. The table of claim 6 wherein there are only two levers.

8. The table of claim 6 wherein said frame is mounted to said work surface and said levers are pivotably mounted to said frame for rotation through an arc in a vertical plane relative to said work surface.

9. A table according to claim 8 wherein said legs further comprise means to guide the movement of said movable leg members with respect to said stationary leg members.

10. A table according to claim 9 wherein said guide members comprise a cylindrical guide member in one of said stationary and movable leg members and wherein the other of said movable and stationary leg members comprises an elongated tube slidably mounted within said cylindrical guide member.

11. A table according to claim 1 wherein said legs further comprise means to guide the movement of said movable leg members with respect to said stationary leg members.

12. A table according to claim 11 wherein said guide members comprise a cylindrical guide member in one of said stationary and movable leg members and wherein the other of said movable and stationary leg members comprises an elongated tube slidably mounted within said cylindrical guide member.

13. A table with a vertically movable top surface, said table comprising:

a work surface;

at least two legs, each of which has a stationary member and a movable member, the movable member being adapted to move vertically with respect to said stationary member;

means for securing the work surface to said leg movable members;

at least two levers pivotably mounted to one of said stationary and movable members of said legs, each of said levers having at one end thereof a leg engagement means to engage the other of said movable and stationary members of one of said legs and having at the other end thereof drive engagement means;

a drive means mounted to one of said stationary and movable members and adapted to vertically drive said drive engagement means on the other ends of said levers, said drive means including a driven shaft, means for rotating said driven shaft, and a nut mounted for travel along said driven shaft;

the improvement which comprises:

a projecting nose on the other of said movable and stationary members of said legs; and said leg engagement means comprising socket forming means, engageable with said projecting nose, for hinge-like movement of said levers relative to the projecting nose during rotation of said lever;

whereby vertical rotation of said drive means results in a corresponding vertical movement of said work surface with respect to said leg stationary members.

14. A table of claim 13 wherein said levers are mounted to said leg movable members.

* * * * *